US010227885B2

(12) United States Patent
Kuwamura et al.

(10) Patent No.: US 10,227,885 B2
(45) Date of Patent: Mar. 12, 2019

(54) TURBINE

(71) Applicant: MITSUBISHI HEAVY INDUSTRIES, LTD., Tokyo (JP)

(72) Inventors: Yoshihiro Kuwamura, Tokyo (JP); Kazuyuki Matsumoto, Tokyo (JP); Hiroharu Oyama, Tokyo (JP); Yoshinori Tanaka, Tokyo (JP); Asaharu Matsuo, Tokyo (JP)

(73) Assignee: MITSUBISHI HITACHI POWER SYSTEMS, LTD., Kanagawa (JP)

( * ) Notice: Subject to any disclaimer, the term of this patent is extended or adjusted under 35 U.S.C. 154(b) by 933 days.

(21) Appl. No.: 14/235,198

(22) PCT Filed: Sep. 18, 2012

(86) PCT No.: PCT/JP2012/073831

§ 371 (c)(1),
(2) Date: Jan. 27, 2014

(87) PCT Pub. No.: WO2013/042660

PCT Pub. Date: Mar. 28, 2013

(65) Prior Publication Data

US 2014/0154061 A1 Jun. 5, 2014

(30) Foreign Application Priority Data

Sep. 20, 2011 (JP) ..... 2011-204138

(51) Int. Cl.
*F01D 11/08* (2006.01)
*F01D 5/22* (2006.01)
(Continued)

(52) U.S. Cl.
CPC ..... *F01D 11/08* (2013.01); *F01D 5/225* (2013.01); *F01D 11/001* (2013.01); *F01D 11/02* (2013.01); *F05D 2250/182* (2013.01)

(58) Field of Classification Search
CPC ..... F01D 11/08; F01D 5/225; F01D 11/02; F05D 2250/182
See application file for complete search history.

(56) References Cited

U.S. PATENT DOCUMENTS 3,897,169 A * 7/1975 Fowler ..... F01D 5/225 277/419
5,244,216 A * 9/1993 Rhode ..... F16J 15/4472 277/303
(Continued)

FOREIGN PATENT DOCUMENTS

CN 2725533 9/2005
EP 0 943 849 9/1999
(Continued)

OTHER PUBLICATIONS

English translation of JP 56047603 A obtain from JPO, https://www4.j-platpat.inpit.go.jp/eng/tokujitsu/tkbs_en/TKBS_EN_GM101_Top.action , Oct. 19, 2016 English translation of JP 2011012631 A and JP 2002228014 A obtain from Espacenet, https://www.epo.org/index.html , Oct. 19, 2016.*
(Continued)

*Primary Examiner* — Richard Edgar
*Assistant Examiner* — Michael Sehn
(74) *Attorney, Agent, or Firm* — Wenderoth, Lind & Ponack, L.L.P.

(57) ABSTRACT

Provided is a turbine. One of a tip portion of a blade and a portion of a partition plate outer ring corresponding to the tip portion of the blade is provided with a step part having a step face that protrudes toward the other, and the other is provided with seal fins) extending out with respect to the step part and forming minute clearance between the step part and the other. The step part facing the seal fins is configured to protrude so that a cavity forming a main vortex and counter vortex being formed by the main vortex are formed on an
(Continued)

upstream side of the seal fins. The cavity is formed so that an axial width dimension and a radial height dimension satisfy Formula expressed by $0.45 \leq D/W \leq 2.67$.

26 Claims, 7 Drawing Sheets

(51) Int. Cl.
*F01D 11/00* (2006.01)
*F01D 11/02* (2006.01)

(56) References Cited

U.S. PATENT DOCUMENTS

| | | | | |
|---|---|---|---|---|
| 6,068,443 | A * | 5/2000 | Aoki | F01D 11/08 415/173.1 |
| 6,102,655 | A | 8/2000 | Kreitmeier | |
| 7,246,994 | B2 | 7/2007 | Lewis | |
| 8,784,046 | B2 * | 7/2014 | Kuwamura | F01D 5/225 415/173.5 |
| 8,801,371 | B2 * | 8/2014 | Kreiselmaier | F01D 5/225 415/116 |
| 2012/0288360 | A1 * | 11/2012 | Kuwamura | F01D 5/225 415/173.1 |
| 2012/0321449 | A1 * | 12/2012 | Matsumoto | F01D 11/08 415/173.6 |
| 2013/0129493 | A1 * | 5/2013 | Matsumoto | F01D 5/225 415/191 |

FOREIGN PATENT DOCUMENTS

| | | | |
|---|---|---|---|
| EP | 2 540 987 | | 1/2013 |
| JP | 56047603 | A * | 4/1981 |
| JP | 11-148307 | | 6/1999 |
| JP | 2002-228014 | | 8/2002 |
| JP | 2002228014 | A * | 8/2002 |
| JP | 2006-291967 | | 10/2006 |
| JP | 2009-47043 | | 3/2009 |
| JP | 2011-12631 | | 1/2011 |
| JP | 2011012631 | A * | 1/2011 |
| JP | 2011-080452 | | 4/2011 |
| JP | 2011-174451 | | 9/2011 |
| JP | 2011-208602 | | 10/2011 |
| JP | 2012-132397 | | 7/2012 |

OTHER PUBLICATIONS

English translation of JP 56047603 A obtain from JPO, https://www4.j-platpat.inpit.go.jp/eng/tokujitsu/tkbs_en/TKBS_EN_GM101_Top.action , Apr. 28, 2017.*

Extended European Search Report dated Apr. 10, 2015 in corresponding European Patent Application No. 12833997.5.

Chinese Office Action dated Nov. 18, 2014 in corresponding Chinese Patent Application No. 201280037866.9 with English translation.

International Search Report dated Dec. 18, 2012 in International (PCT) Application No. PCT/JP2012/073831 with English Translation.

Written Opinion of the International Searching Authority dated Dec. 18, 2012 in International (PCT) Application No. PCT/JP2012/073831 with English Translation.

Japanese Notice of Allowance dated Mar. 4, 2014 in corresponding Japanese Patent Application No. 2011-204138 with English Translation.

* cited by examiner

TURBINE

Priority is claimed on Japanese Patent Application No. 2011-204138, filed on Sep. 20, 2011, the content of which is incorporated herein by reference.

TECHNICAL FIELD

The present invention relates to a turbine used in, for instance, a power plant, a chemical plant, a gas plant, a steel plant, or a vessel.

BACKGROUND ART

As a type of steam turbine, steam turbines having a casing, a shaft body (rotor) that is rotatably installed inside the casing, a plurality of turbine vanes that are fixedly disposed on an inner circumference of the casing, and a plurality of turbine blades that are radially installed on the shaft body on a downstream side of the plurality of turbine vanes have been known. In the case of an impulse turbine among these steam turbines, pressure energy of steam is converted into velocity energy by the turbine vanes, and the velocity energy is converted into rotating energy (mechanical energy) by the turbine blades. Further, in the case of a reaction turbine, the pressure energy is converted into velocity energy even inside the turbine blades, and into rotating energy (mechanical energy) by a reaction force with which the steam is spouted out.

In this type of steam turbine, radial clearance is formed between a tip portion of the turbine blade and the casing surrounding the turbine blade to form a flow passage of the steam. Further, the radial clearance is also formed between the tip portion of the turbine vane and the shaft. However, leakage steam passing through the clearance of the tip portion of the turbine blade on the downstream side does not offer a rotating force to the turbine blade. Further, leakage steam passing through the clearance of the tip portion of the turbine vane on the downstream side hardly offers a rotating force to the downstream turbine blade, because the pressure energy of steam is not converted into the velocity energy by the turbine vane. Accordingly, to improve performance of the steam turbine, it is necessary to reduce the amount of the leakage steam passing through the clearance.

In Patent Literature 1 below, there is a proposal for a structure in which the tip portion of the turbine blade are provided with step part whose heights are gradually increased from the axial upstream side to the downstream side, and the casing is provided with seal fins having clearance with respect to the step part.

With this configuration, a leakage flow passing through the clearance of the seal fins collides with end edges of the step part which form step faces of the step part, and increases flow resistance. Thereby, the leakage flow rate is reduced.

CITATION LIST

Patent Literature

[Patent Literature 1]
Japanese Unexamined Patent Application, First Publication No. 2006-291967

SUMMARY OF INVENTION

Technical Problem

However, there is great demand for improvement in the performance of the steam turbine, and thus there is a need to further reduce the leakage flow rate.

The present invention has been made in consideration of such circumstances and an object of the present invention is to provide a high-performance turbine capable of further reducing a leakage flow rate.

Solution to Problem

According to a first aspect of the present invention, a turbine includes blades, and structures that are provided at sides of tips of the blades with a gap and rotate around axes thereof relative to the blades. One of a tip portion of the blade and a portion of the structure which corresponds to the tip portion of the blade includes step part that have a step face that protrudes toward the other, the other is provided with seal fins extending out with respect to the step part and form minute clearance (H) between the step part and the other. The step part facing the seal fins is configured to protrude so that a cavity forming a main vortex and counter vortex being formed by the main vortex are formed on an upstream side of the seal fins, and the cavity is formed so that the axial width dimension (W) and the radial height dimension (D) satisfy Formula (1) below.

$$0.45 \leq D/W \leq 2.67 \quad (1)$$

According to this turbine, a fluid flowing into the cavity is adapted to collide with the step faces of the step part which form end edges of the step part, i.e. faces of the step part which are directed to the upstream side of the step part, and return to the upstream side. Thereby, the main vortex is generated to turn in a first direction. In this case, especially in the end edges of the step faces, a partial flow is separated from each main vortex. Thereby, each counter vortex that is a separated vortex turning in the opposite direction of the first direction is generated. The counter vortexes act as a strong downflow at the upstream of seal fins, and exert a flow contracting effect on the fluid passing through minute clearance H formed between tip portions of the seal fins and the step part. Furthermore, since a fall in static pressure is generated inside each counter vortex, it is possible to reduce the differential pressure between the upstream side and the downstream side of the seal fins.

Further, the relationship between the axial width dimension W and the radial height dimension D is defined to satisfy Formula (1) based on simulation results to be described below. Thereby, when a depth of the cavity is shallow, i.e. when D/W is less than 0.45, it is possible to prevent a phenomenon in which the counter vortexes are weakened by attachment to the structure, and a differential pressure reducing effect and the flow contracting effect are not sufficiently obtained. Further, it is possible to prevent a phenomenon in which the shape of each main vortex becomes oblate in an axial direction, and a flow in front of the step part is weakened, and thereby the flow contracting effect and the differential pressure reducing effect of each counter vortex are reduced. In contrast, when the depth of the cavity is deep, i.e. when D/W is more than 2.67, it is possible to prevent a phenomenon in which the shape of each main vortex becomes oblate in a radial direction, and the flow in front of the step part is weakened, and thereby the flow contracting effect and the differential pressure reducing effect of each counter vortex are reduced.

According to a second aspect of the present invention, in the turbine according to the first aspect of the present invention, the cavity is formed so that an axial width dimension W and a radial height dimension D satisfy Formula (2) below.

$$0.56 \leq D/W \leq 1.95 \quad (2)$$

The relationship between the axial width dimension W and the radial height dimension D is defined to satisfy Formula (2) based on simulation results to be described below. Thereby, the flow contracting effect caused by the downflow of each counter vortex and the differential pressure reducing effect caused by the fall of the static pressure inside each counter vortex can be further improved, and the leakage flow rate of the fluid can be further reduced.

According to a third aspect of the present invention, in the turbine according to the first aspect of the present invention, the cavity is formed so that the axial width dimension W and the radial height dimension D satisfy Formula (3) below.

$$0.69 \leq D/W \leq 1.25 \quad (3)$$

The relationship between the axial width dimension W and the radial height dimension D is defined to satisfy Formula (3) based on simulation results to be described below. Thereby, the flow contracting effect caused by the downflow of each counter vortex and the differential pressure reducing effect caused by the fall of the static pressure inside each counter vortex can be further improved, and the leakage flow rate of the fluid can be further reduced.

According to a fourth aspect of the present invention, in the turbine according to the first to third aspects of the present invention, distances L between the seal fins and end edges of the step part which are located on the upstream side of the step part and the minute clearance H are formed to satisfy Formula (4) below with respect to at least one of the distances (L).

$$0.7H \leq L \leq 0.3W \quad (4)$$

A relationship between the distance L and the minute clearance H formed between the tip portion of the seal fin and the step part is defined to satisfy Formula (4) based on simulation results to be described below. Thereby, the flow contracting effect and the differential pressure reducing effect caused by each counter vortex can be further improved, and the leakage flow rate can be further reduced.

According to a fifth aspect of the present invention, in the turbine according to the first to fourth aspects of the present invention, distances L between the seal fins and end edges of the step part which are located on the upstream side of the step part and the minute clearance H are formed to satisfy Formula (5) below with respect to at least one of the distances (L).

$$1.25H \leq L \leq 2.75H \text{ (where } L \leq 0.3W) \quad (5)$$

The relationship between the distance L and the minute clearance H formed between the tip portion of the seal fin and the step part is defined to satisfy Formula (5) based on simulation results to be described below. Thereby, the flow contracting effect and the differential pressure reducing effect caused by each counter vortex can be further improved, and the leakage flow rate can be further reduced.

Effects of Invention

According to the turbine, due to the flow contracting effect and the differential pressure reduction caused by each counter vortex, it is possible to reduce the leakage flow rate of the fluid, and achieve high performance thereof.

DESCRIPTION OF EMBODIMENTS

Hereinafter, a steam turbine (turbine) 1 according to an embodiment of the present invention will be described.

The steam turbine 1 is an external combustion engine producing energy from steam S as rotation power, and is used for an electric generator at a power plant.

Figure 1:
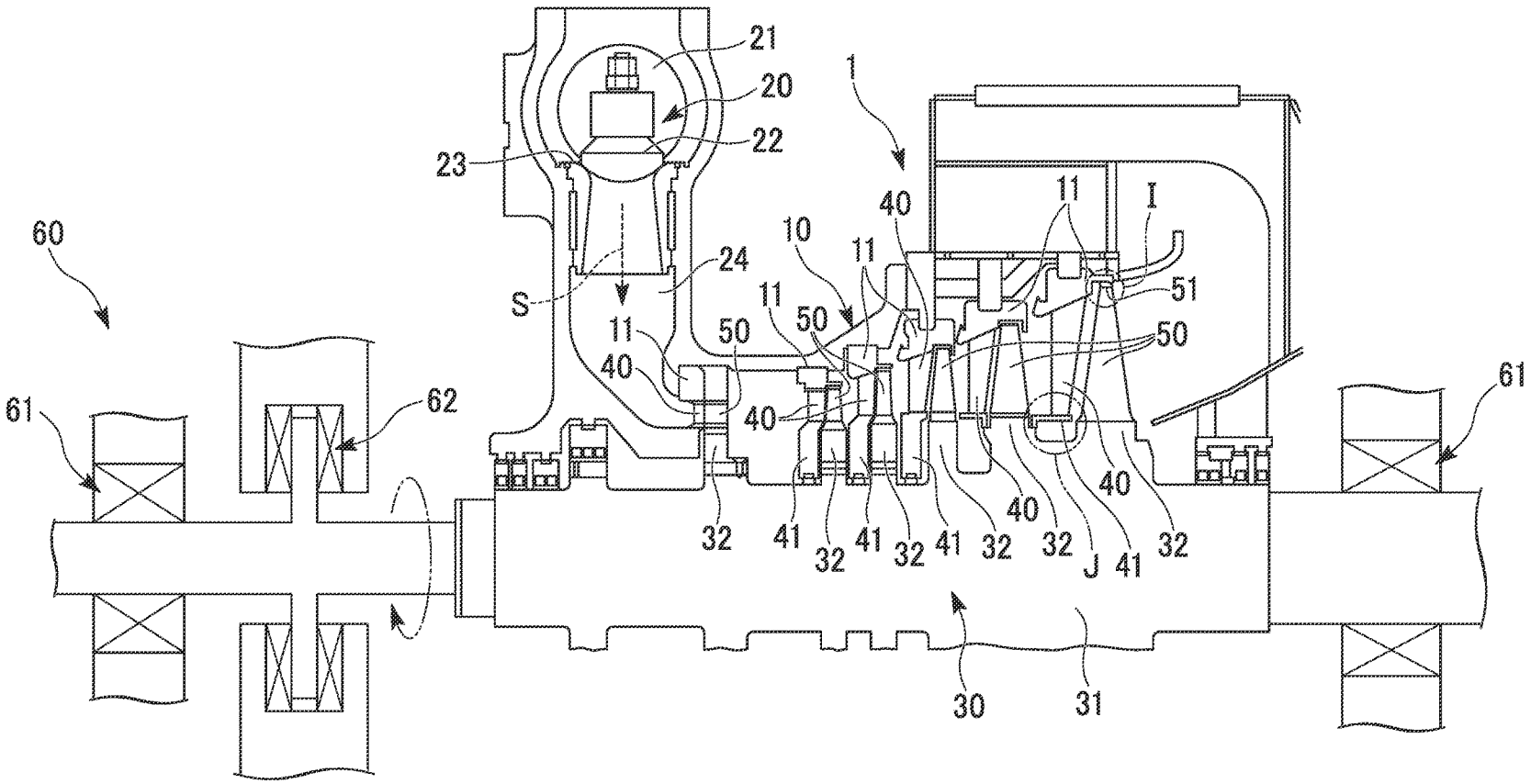
FIG. 1 is a cross-sectional view showing a schematic configuration of a steam turbine according to an embodiment of the present invention.

As shown in FIG. 1, the steam turbine 1 includes a casing 10, adjusting valves 20 adjusting a quantity and pressure of steam S flowing into the casing 10, a shaft (structure) 30 that is rotatably installed inside the casing 10 and transmits power to a machine such as an electric generator (not shown), turbine vanes 40 held by the casing 10, turbine blades 50 installed on the shaft 30, and a bearing section 60 that supports the shaft 30 so as to allow the shaft 30 to be rotated about its axis, as main components.

An internal space of the casing 10 is air-tightly closed. The casing 10 forms a flow passage of the steam S. Partition plate outer rings 11 into which the shaft 30 is inserted and which have a ring shape are firmly fixed to an inner wall of the casing 10.

The plurality of adjusting valves 20 are attached to the interior of the casing 10. Each adjusting valve 20 includes an adjusting valve chamber 21 into which the steam S flows from a boiler (not shown), a valve body 22, and a valve seat 23. When the valve body 22 is separated from the valve seat 23, the steam flow passage is open, and the steam S flows into the internal space of the casing 10 via the steam chamber 24.

The shaft 30 includes a shaft main body 31 and a plurality of discs 32 extending from an outer circumference of the shaft main body 31 in a radial direction. The shaft 30 transmits rotation energy to the machine such as the electric generator (not shown).

A number of the turbine vanes 40 are radially disposed so as to surround the shaft 30, constituting a turbine vane groups. The turbine vanes 40 are held by the respective partition plate outer rings 11 described above. These turbine vanes 40 are arranged so that radial inner sides thereof are coupled by ring-shaped hub shrouds 41 into which the shaft 30 is inserted and tip portions thereof have a radial clearance with respect to the shaft 30.

The six annular turbine vane groups constituted of the plurality of turbine vanes 40 are formed at intervals in an axial direction. The annular turbine vane groups convert pressure energy of the steam S into velocity energy, and guide the velocity energy toward the turbine blades 50 adjacent to a downstream side.

The turbine blades 50 are firmly attached to outer circumferences of the discs 32 which the shaft 30 has. A number of turbine blades 50 are radially disposed at a downstream side of the annular turbine vane groups, constituting annular turbine blade groups.

The annular turbine vane groups and the annular turbine blade groups are configured in a one-set one-stage form. That is, the steam turbine 1 is formed in six stages. In the final stage among these stages, tip portions of the turbine blades 50 are made up of tip shrouds 51 extending in a circumferential direction.

Here, the turbine vanes 40, the hub shrouds 41, the tip shrouds 51, and the turbine blades 50 are "blades" in the present invention. When the turbine blades 50 and the tip shrouds 51 are defined as "blades," the partition plate outer rings 11 are "structures". On the other hand, when the turbine vanes 40 and the hub shrouds 41 are defined as "blades," the shaft 30 is a "structure" (see a relevant part J in FIG. 1). In the following description, the partition plate outer rings 11 are defined as the "structure", and the turbine blades 50 are defined as "blades."

Figure 2:
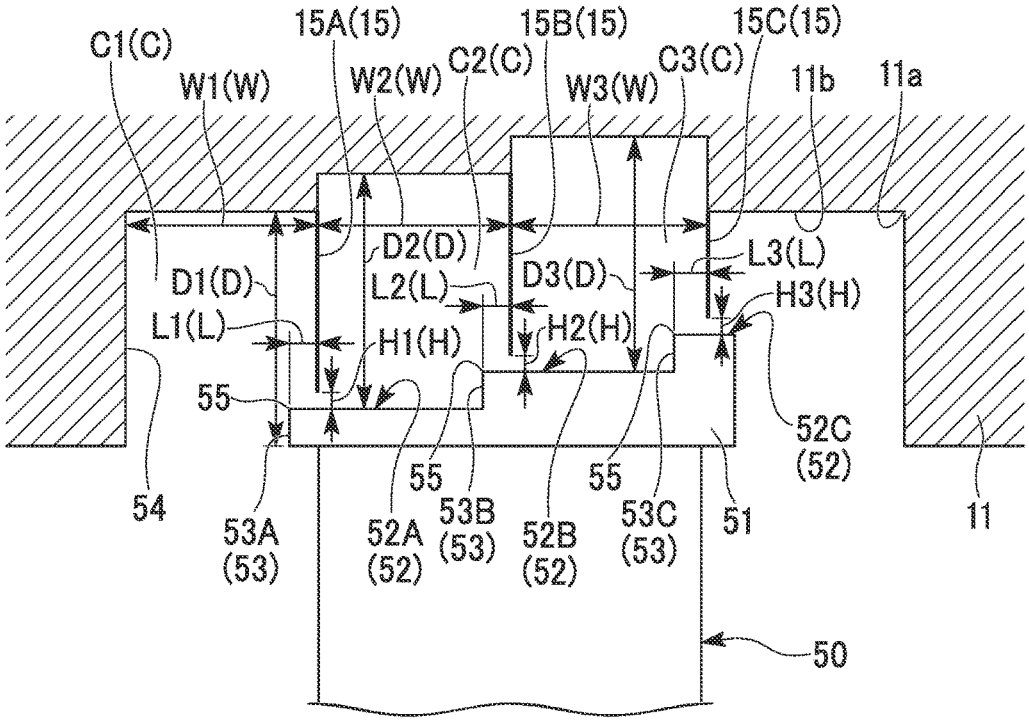
FIG. 2 is an enlarged cross-sectional view that shows the steam turbine according to the embodiment of the present invention and shows a relevant part I of FIG. 1.

As shown in FIG. 2, the tip shroud 51 serving as the tip portion of the turbine blade (blade) 50 is disposed in the radial direction of the casing 10 so as to face the partition plate outer ring (structure) 11 by way of a clearance. The tip shroud 51 is provided with step part 52 (52A to 52C) that have step faces 53 (53A to 53C) and protrude to the side of the partition plate outer ring 11.

In the present embodiment, the tip shroud 51 includes three step parts 52 (52A to 52C). These three step parts 52A to 52C are arranged so that a protrusion height from the turbine blade 50 is gradually increased from an axial upstream side to an axial downstream side of the shaft 30. That is, in the step parts 52A to 52C, the step faces 53 (53A to 53C) forming steps are formed toward the front directed to the axial upstream side.

In the partition plate outer ring 11, an annular groove 11*a* is formed in a portion corresponding to the tip shroud 51. The tip shroud 51 is held inside the annular groove 11*a*.

In the present embodiment, in the annular groove 11*a* of the partition plate outer ring 11, groove bottoms 11*b* are formed in an axially step shape so as to correspond to the respective step parts 52 (52A to 52C) in an axial direction. That is, radial distances from the step parts 52 (52A to 52C) to the groove bottoms 11*b* are constant.

Further, the groove bottoms 11*b* are provided with three seal fins 15 (15A to 15C) extending toward the tip shroud 51 in a radial inward direction.

These seal fins 15 (15A to 15C) are provided to correspond to the step parts 52 (52A to 52C) one to one to extend from the respective groove bottoms 11*b*. Between the seal fins 15 (15A to 15C) and the corresponding step parts 52, minute clearance H are formed in a radial direction. Dimensions of the minute clearance H (H1 to H3) are decided in consideration of thermal elongations of the casing 10 and the turbine blade 50, and a centrifugal elongation of the turbine blade 50, and are set to the smallest ones within a safe range in which both the seal fins and the step parts are not in contact with each other.

In the present embodiment, all of H1 to H3 have the same dimensions. However, these dimensions may be appropriately changed as needed.

With this constitution, between the side of the tip shroud 51 and the partition plate outer ring 11, cavities C (C1 to C3) are formed inside the annular groove 11*a* so as to correspond to the respective step part 52.

The cavities C (C1 to C3) are formed between the seal fins 15 corresponding to the respective step parts 52 and partitions facing the seal fins 15 on the axial upstream side.

In the first cavity C1 corresponding to the first-stage step part 52A located at the axial most upstream side, the partition is formed by an inner wall 54 of the annular groove 11*a* which is located at the axial upstream side. Accordingly, between the inner wall 54 and the seal fin 15A corresponding to the first-stage step part 52A as well as between the side of the tip shroud 51 and the partition plate outer ring 11, the first cavity C1 is formed.

Further, in the second cavity C2 corresponding to the second-stage step part 52B, the partition is formed by the seal fin 15A corresponding to the step part 52A located at the axial upstream side. Accordingly, between the seal fin 15A and the seal fin 15B as well as between the tip shroud 51 and the partition plate outer ring 11, the second cavity C2 is formed.

Similarly, between the seal fin 15B and the seal fin 15C, as well as between the tip shroud 51 and the partition plate outer ring 11, the third cavity C3 is formed.

In these cavities C (C1 to C3), width dimensions of the cavities C (C1 to C3) which are axial distances between tip portions of the seal fins 15 (15A to 15C) and the partitions on the same diameters as the tip portions of the seal fins 15 (15A to 15C) are defined as cavity widths W (W1 to W3).

That is, in the first cavity C1, the distance between the inner wall 54 and the seal fin 15A is defined as a cavity width W1. Further, in the second cavity C2, the distance between the seal fin 15A and the seal fin 15B is defined as a cavity width W2. In addition, in the third cavity C3, the distance between the seal fin 15B and the seal fin 15C is defined as a cavity width W3. In the present embodiment, all of W1 to W3 have the same dimensions. However, these dimensions may be appropriately changed as needed.

Further, in the cavities C (C1 to C3), height dimensions of the cavities C (C1 to C3) which are radial distances between the tip shroud 51 and the partition plate outer ring 11 are defined as cavity heights D (D1 to D3).

In detail, in the second cavity C2, a radial distance between the step part 52A and the partition plate outer ring 11 is defined as a cavity height D2. In the third cavity C3, a radial distance between the step part 52B and the partition plate outer ring 11 is defined as a cavity height D3. However, in the first cavity C1, the distance between the partition plate outer ring 11 and a surface of the step part 52A which is directed to a radial inner side of the tip shroud 51 which corresponds to a position of a rotational axis direction of the step part 52A is defined as a cavity height D1.

Figure 3:
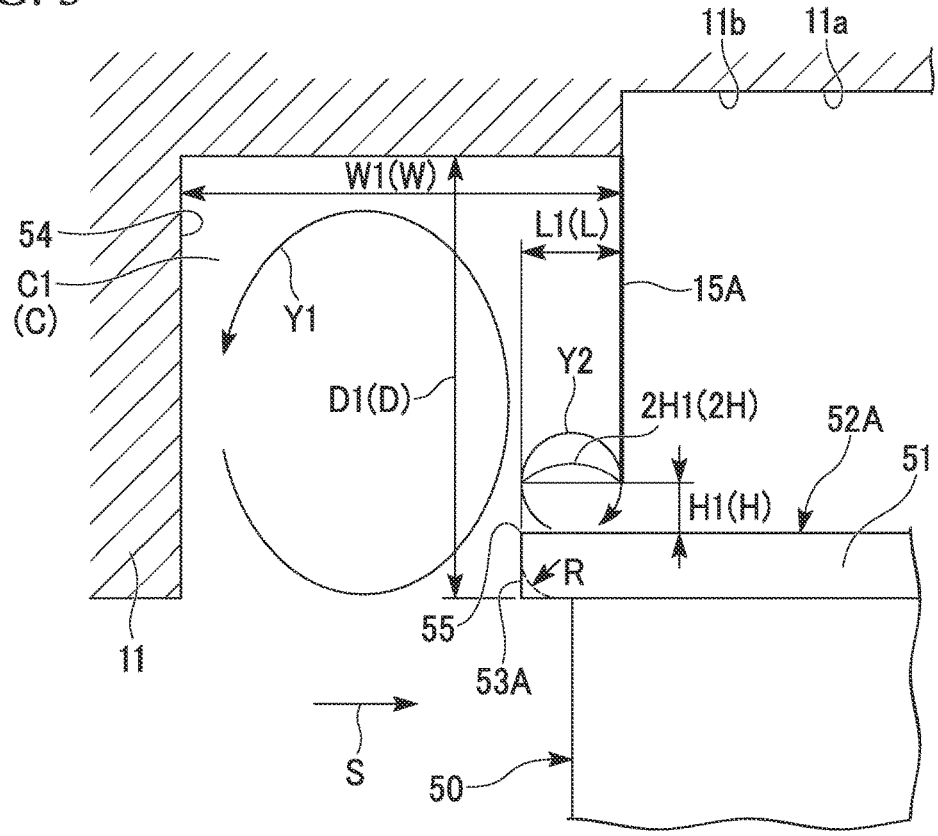
FIG. 3 is a view that shows the steam turbine according to the embodiment of the present invention and describes an operation of the relevant part I of FIG. 1.

Further, as shown in FIG. 3, when round chamfering R is performed on surfaces directed to the axial upstream side and the radial inner side of the step part 52A, the distance between the partition plate outer ring 11 and a position at which a straight line portion of the surface directed to the radial inner side extends to the axial upstream side is defined as the cavity height D1.

In the present embodiment, all of D1 to D3 have the same dimensions. However, these dimensions may be appropriately changed as needed.

The cavity widths W (W1 to W3) and the cavity heights D (D1 to D3) are formed so as to satisfy Formula (1) below.

$$0.45 \leq D/W \leq 2.67 \quad (1)$$

Further, the cavity widths W (W1 to W3) and the cavity heights D (D1 to D3) are preferably formed so as to satisfy Formula (2) below, and more preferably Formula (3) below.

$$0.56 \leq D/W \leq 1.95 \quad (2)$$

$$0.69 \leq D/W \leq 1.25 \quad (3)$$

Furthermore, when axial distances between the seal fins 15 and end edges 55 of the respective step part 52 corresponding to the seal fins on the axial upstream side are set to L (L1 to L3), at least one of the distances L is formed so as to satisfy Formula (4) below.

$$0.7H \leq L \leq 0.3W \quad (4)$$

Further, at least one of the distances L is preferably formed so as to satisfy Formula (5) below.

$$1.25H \leq L \leq 2.75H \text{ (where } L \leq 0.3W) \quad (5)$$

The bearing section 60 includes a journal bearing device 61 and a thrust bearing device 62, and rotatably supports the shaft 30.

According to this steam turbine 1, first, when the adjusting valve 20 (see FIG. 1) is in an open state, the steam S flows from the boiler (not shown) into the internal space of the casing 10.

The steam S flowing into the internal space of the casing 10 sequentially passes through the annular turbine vane group and the annular turbine blade group in each stage. In this case, pressure energy is converted into velocity energy by the turbine vanes 40. Then, most of the steam S passing through the turbine vanes 40 flows between the turbine blades 50 constituting the same stage, and the velocity energy of the steam S is converted into rotation energy by the turbine blades 50. Rotation is provided to the shaft 30. On the other hand, a part of the steam S (e.g. several percent) flows out of the turbine vanes 40, and then flows into the annular groove 11*a* to become so-called leakage steam.

Here, as shown in FIG. 3, the steam S flowing into the annular groove 11*a* flows into the first cavity C1 first, collides with the step face 53A of the step part 52A, and is adapted to return back to the upstream side. A flow, for example a main vortex Y1 rotating in a counterclockwise direction shown in FIG. 3, is generated.

In this case, especially at the end edge 55 of the step part 52A, a partial flow is separated from the main vortex Y1. Thereby, a counter vortex Y2 is generated to rotate in the opposite direction of the main vortex Y1, in the present example, in a clockwise direction shown in FIG. 3. The counter vortex Y2 exerts a flow contracting effect of reducing the leakage flow passing through the minute clearance H1 between the seal fin 15A and the step part 52A.

That is, as shown in FIG. 3, when the counter vortex Y2 is formed, a downflow directing a velocity vector to the radial inner side is generated from the counter vortex Y2 on the axial upstream side of the seal fin 15A. This downflow retains an inertial force directed to the radial inner side just before the minute clearance H1. For this reason, an effect of decreasing on the radial inner side, i.e. a flow contracting effect, is produced on the flow passing through the minute clearance H1, and the leakage flow rate can be reduced.

Further, since a fall in static pressure is generated inside the counter vortex Y2, a differential pressure between the upstream side and the downstream side of the seal fin 15A can be reduced. As a result, the leakage flow rate can be reduced.

Even on the upstream side of the seal fins 15B and 15C, like the upstream side of the seal fin 15A, the counter vortex Y2 is formed, and thereby the leakage flow rate can be reduced.

Here, according to the counter vortex Y2, when ratios between the cavity heights D (D1 to D3) and the cavity widths W (W1 to W3) of the cavities C (C1 to C3) are small to some extent, the counter vortex Y2 is weakened by attachment to the partition plate outer ring 11, and the differential pressure reducing effect and the flow contracting effect cannot be sufficiently obtained.

Furthermore, when the ratios between the cavity heights D (D1 to D3) and the cavity widths W (W1 to W3) of the cavities C (C1 to C3) in the counter vortex Y2 are small to some extent, a shape of the main vortex Y1 becomes flat in the axial direction, and flows in front of the step parts 52 (52A to 52C) are weakened. Thereby, the differential pressure reducing effect and the flow contracting effect of the counter vortex Y2 are reduced.

In contrast, when the ratios between the cavity heights D (D1 to D3) and the cavity widths W (W1 to W3) are large to some extent, the shape of the main vortex Y1 becomes flat in the radial direction, and the flows in front of the step parts 52 (52A to 52C) are weakened. Thereby, the differential pressure reducing effect and the flow contracting effect of the counter vortex Y2 are reduced.

However, in the present embodiment, since the cavity heights D (D1 to D3) and the cavity widths W (W1 to W3) are set to satisfy Formula (1) above, preferably Formula (2) or (3) above, the differential pressure reducing effect and the flow contracting effect can be sufficiently obtained.

Further, as shown in FIG. 3, assuming that the counter vortex Y2 forms a perfect circle, when a diameter of the counter vortex Y2 becomes twice as large as the minute clearance H1, and an outer circumference of the counter vortex Y2 comes into contact with the seal fin 15A, i.e., when L1=2H1 (L=2H), a velocity component directed to the radial inner side with regard to the downfall of the counter vortex Y2 has a maximum position consistent with a tip (inner end edge) of the seal fin 15A. Accordingly, since the downflow goes more smoothly just before the minute clearance H1, the flow contracting effect exerted on the leakage flow is maximized.

In the present embodiment, the distances L (L1 to L3) are set to satisfy Formulas (4) above, preferably Formula (5) above, the differential pressure reducing effect and the flow contracting effect can be sufficiently obtained.

Here, when a condition of one of Formulas (1) to (5) above is met, the flow contracting effect and the differential pressure reducing effect intended by the present invention can be obtained without depending on operating conditions. However, since the intended effects cannot be obtained when such a condition is met during a stop period rather than during an operation period, it is essential for the conditions of Formulas (1) to (5) above to "be met during the operation period."

In the steam turbine 1 according to the present embodiment, the downflow caused by the counter vortex Y2 can exert a force directed to the radial inner side to the steam S on the upstream side of the seal fins 15 (15A to 15C). Accordingly, with respect to the steam S passing through the minute clearance H (H1 to H3), the flow contracting effect can be exerted, and the leakage flow rate can be reduced.

Further, due to the fall in the static pressure inside the counter vortex Y2, the differential pressure reducing effect can be obtained. As a result, the leakage flow rate can be reduced.

The steam turbine 1 is constituted so that the cavity widths W (W1 to W3) and the cavity heights D (D1 to D3) satisfy Formula (1), (2), or (3). For this reason, the counter vortex Y2 can be prevented from being weakened by the attachment to the partition plate outer ring 11, the flow contracting effect and the differential pressure reducing effect exerted on the steam S can be sufficiently obtained.

Further, the shape of the main vortex Y1 can be prevented from becoming flat, and the flow contracting effect caused by the counter vortex Y2 can be sufficiently obtained. Furthermore, due to the differential pressure reducing effect, the flow rate of the steam S passing through the minute clearance H (H1 to H3) can be reduced, and the leakage flow rate can be reduced. Thereby, it is possible to improve the performance of the steam turbine 1.

In addition, the distances L (L1 to L3) are set to satisfy Formula (4) above, preferably Formula (5) above. Thereby, the downflow of the counter vortex Y2 can be generated in full. Due to the reduction of the leakage flow rate caused by the flow contracting effect and the differential pressure reducing effect, it is possible to further improve the performance of the steam turbine 1.

The embodiment of the present invention has been described in detail with reference to the drawings. However, the specific constitution is not limited to the present embodiment, and a modification thereof is also included without departing from the gist of the present invention.

For example, in the present embodiment, the reduction of the leakage flow rate of the steam S using the counter vortex Y2 between the turbine blade 50 and the partition plate outer ring 11 has been described. However, as described above, a similar technique can also be applied between the turbine vane 40 and the shaft 30, and the leakage flow rate of the steam S can be reduced.

Figure 9:
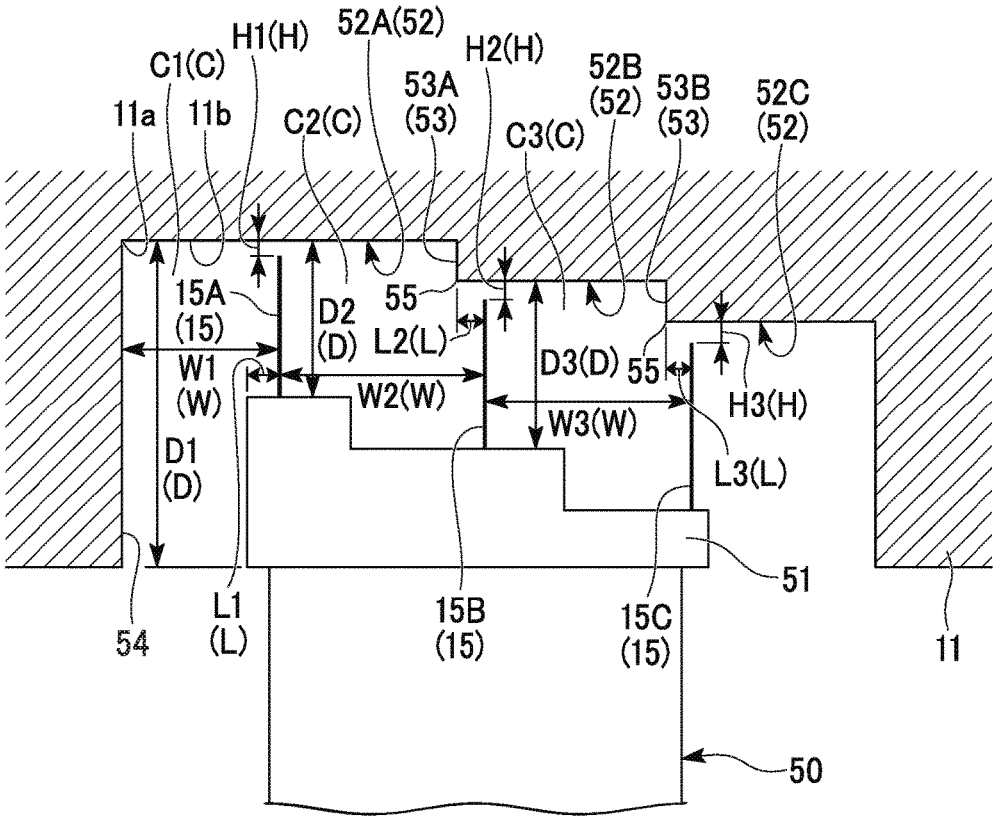
FIG. 9 is an enlarged cross-sectional view that shows the steam turbine according to another embodiment of the present invention.

Furthermore, in the embodiment, the step parts 52 (52A to 52C) are formed on the tip shroud 51 constituting the tip portion of the turbine blade 50, and the seal fins 15 (15A to 15C) are provided for the partition plate outer ring 11. However, as shown in FIG. 9, the step parts 52 may be formed on the partition plate outer ring 11, and the seal fins 15 may be provided for the tip shroud 51. In this case, the counter vortex Y2 is not formed in the cavity C of the axial most upstream side. For this reason, the numerical limitation of D/W of the present invention cannot be applied without change. Accordingly, even when the step parts 52 are formed on the side of the shaft 30 using the turbine vane 40 and the hub shroud 41 as the "blades." the numerical limitation of D/W of the present invention cannot be applied either.

Further, the side on which the seal fins 15 are provided may be formed in a step shape, for instance, in a planar shape, in a tapered surface, or in a curved surface. However, in this case, the cavity heights D (D1 to D3) need to be set to satisfy Formula (1), preferably Formula (2) or (3).

Further, in the present embodiment, the partition plate outer ring 11 provided for the casing 10 is used as the structure. However, the casing 10 itself may be constituted as the structure without providing this partition plate outer ring 11. That is, as long as such a structure is configured to surround the turbine blades 50, and the flow passage is restricted so that a fluid flows between the turbine blades, any member may be used.

Further, in the present embodiment, the plurality of step parts 52 are provided, and thus the plurality of cavities C are formed as well. The number of step parts 52 and the number of cavities C corresponding to the step parts 52 are arbitrary, and may be one, three, or four or more.

In addition, as in the present embodiment, the seal fins 15 and the step parts 52 do not necessarily correspond to one another one to one. Further, in comparison with the seal fins 15, the step parts 52 need not be reduced by one. The number of seal fins 15 and the number of step parts 52 can be arbitrarily designed.

Furthermore, in the present embodiment, the aforementioned invention is applied to the turbine blades 50 and the turbine vanes 40 of the final stage. However, the aforementioned invention may be applied to the turbine blades 50 and the turbine vanes 40 of the other final stages.

Further, in the present embodiment, the aforementioned invention is applied to a condensed steam turbine. However, the aforementioned invention may be applied to another type of steam turbine, for instance a turbine type such as a two-stage extraction turbine, an extraction turbine, or a mixing turbine.

Furthermore, in the present embodiment, the aforementioned invention is applied to a steam turbine. However, the aforementioned invention may also be applied to a gas turbine, and moreover the aforementioned invention may be applied to all of the machines having the turbine blades.

[Embodiment 1]

Here, from the knowledge that, as described above, there are ratios between the cavity heights D (D1 to D3) and the cavity widths W (W1 to W3) at which the flow contracting effect can be sufficiently obtained, a simulation was carried out, and conditions thereof were verified.

Figure 4:
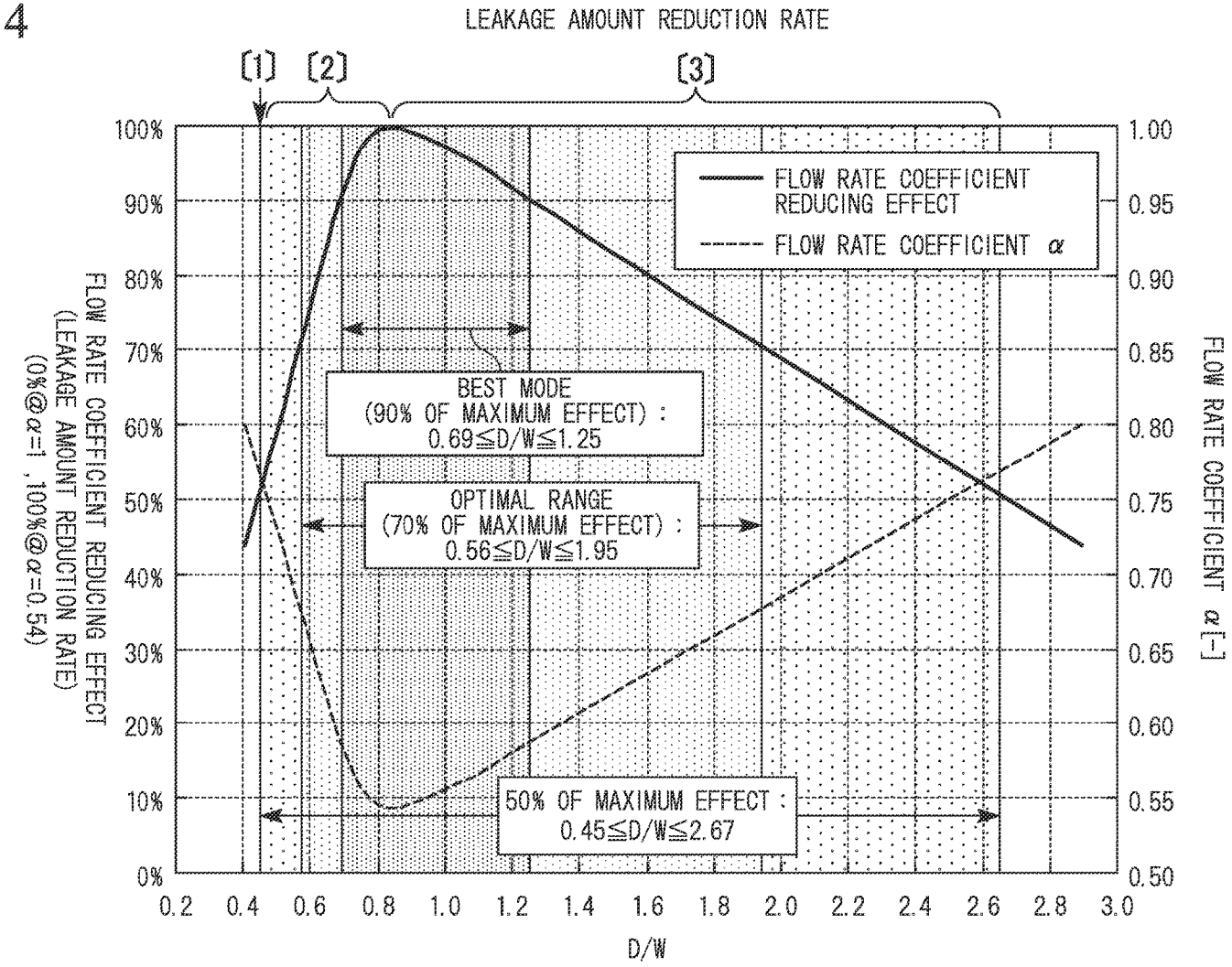
FIG. 4 is a graph showing simulation results (Example 1) of the steam turbine according to the embodiment of the present invention.

The horizontal axis of a graph shown in FIG. 4 indicates numerical values obtained by dividing the cavity height D by the cavity width W and making the result dimensionless. Further, the vertical axes indicate a flow rate coefficient reducing effect and a flow rate coefficient $\alpha$. The flow rate coefficient reducing effect of the vertical axis is set to 0% when the flow rate coefficient $\alpha=1$, i.e. when the leakage flow rate is maximum, and 100% when the maximum flow rate coefficient $\alpha=0.54$ in the present embodiment, i.e. when the leakage flow rate is minimized. With respect to the maximum leakage flow rate when the flow rate coefficient $\alpha=1$, it is indicated how much the flow rate coefficient reducing effect, i.e. a leakage amount reduction rate, is obtained as a percentage (%).

It could be confirmed from the results shown in FIG. 4 that the cavity height D and the cavity width W were preferably set to a range within which they satisfied Formula (1) above, more preferably a range within which they satisfied Formula (2) above, or further preferably a range within which they satisfied Formula (3) above.

In the range [1] (D/W=0.45) shown in FIG. 4, it could be confirmed that the leakage amount reduction rate of about 50% could be achieved. Accordingly, when D/W=0.45, the cavity height D was small with respect to the cavity width W. As such, the main vortex Y1 became an oblate shape in the axial direction, so that the main vortex Y1 was weakened, and the counter vortex Y2 was also weakened. For this reason, the flow contracting effect and the differential pressure reducing effect could not be obtained in full. However, it could be confirmed that a certain degree of the effect (about 50%) was obtained.

In the range [2] ($0.45<D/W\leq0.85$) shown in FIG. 4, it could be confirmed that, depending on an increase in D/W, the leakage amount reduction rate was sharply increased, and became about 70% when D/W=0.56, about 90% when D/W=0.69, and 100%, a maximum value, when D/W=0.85. That is, as D/W approached 0.85, the weakening of the counter vortex Y2 as described above was not generated, and the maximum flow contracting effect and the maximum differential pressure reducing effect could be obtained. In contrast, as D/W approached 0.45, the main vortex Y1 became the flat shape in the axial direction, so that the weakening of the main vortex Y1 was generated, and the counter vortex Y2 was also weakened.

Furthermore, it could be confirmed that, as D/W approached 0.45, the leakage amount reduction rate was sharply reduced. This was because the counter vortex Y2 attached to the partition plate outer rings 11, and was sharply weakened, and thereby the flow contracting effect and the differential pressure reducing effect were sharply reduced.

In addition, in the range [3] (0.85<D/W≤2.67) shown in FIG. 4, it could be confirmed that, when D/W=0.85, the leakage amount reduction rate indicated the maximum value, and then was gradually reduced. It could be confirmed that the leakage amount reduction rate was reduced to about 90% when D/W=1.25, about 70% when D/W=1.95, and about 50% when D/W=2.67. Accordingly, since the cavity height D was increased with respect to the cavity width W, the main vortex Y1 became the flat shape in the radial direction, so that the weakening of the main vortex Y1 was generated, and the counter vortex Y2 was also weakened. For this reason, the flow contracting effect and the differential pressure reducing effect could not be obtained in full. However, it could be confirmed that, up to the range of D/W≤2.67, a certain degree of effect (about 50%) was obtained.

In the range [4] (2.67<D/W) shown in FIG. 4, the leakage amount reduction rate was equal to or less than 50%, and the flow contracting effect and the differential pressure reducing effect were not sufficiently obtained by the weakening of the counter vortex Y2 caused by the weakening of the main vortex Y1.

According to the aforementioned simulation results, in the present embodiment, the cavity width W and the cavity height D are set to the range within which they satisfy Formula (1) above, i.e. 0.45≤D/W≤2.67, and the leakage amount reduction rate equal to or more than 50% is obtained. Accordingly, in the steam turbine 1 of the present embodiment, the leakage flow rate is reduced, and the performance thereof can be improved.

Further, when the cavity width W and the cavity height D are set to the range within which they satisfy Formula (2) above, i.e. 0.56≤D/W≤1.95, the leakage amount reduction rate equal to or more than about 70% is obtained. Accordingly, the leakage flow rate is further reduced, and the steam turbine 1 of the present embodiment can realize the higher performance. In addition, when the cavity width W and the cavity height D are set to the range within which they satisfy Formula (3) above, i.e. 0.69≤D/W≤1.25, the leakage amount reduction rate equal to or more than about 90% is obtained. Accordingly, the reduced leakage flow rate is further reduced, and the higher performance can be realized.

[Embodiment 2]

Next, from the knowledge that, as described above, there are distances L (L1 to L3) at which the effect of the downflow of the counter vortex Y2 can be maximized and the sufficient flow contracting effect can be obtained, a simulation was carried out, and conditions thereof were verified.

Figure 5:
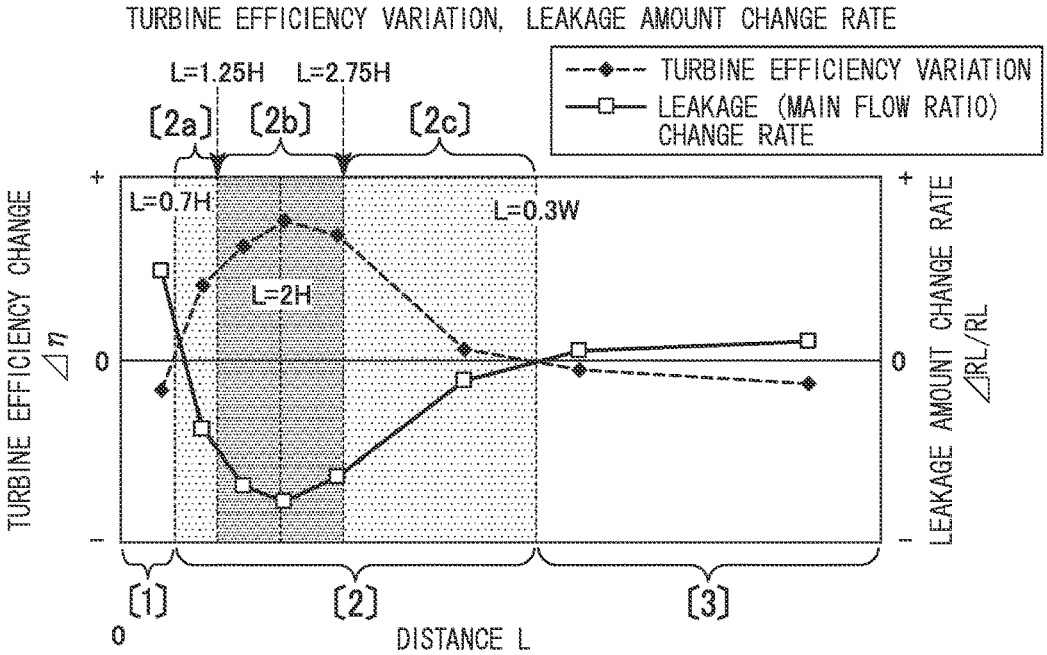
FIG. 5 is a graph showing simulation results (Example 2) of the steam turbine according to the embodiment of the present invention.

The horizontal axis of a graph shown in FIG. 5 indicates a dimension (length) of the distance L, and the vertical axes indicate a turbine efficiency change and a leakage amount change rate (a change rate of the leakage flow rate). In regard to the turbine efficiency change and the leakage amount change rate, magnitudes of turbine efficiency and the leakage flow rate in a typical step fin structure are indicated. Further, in this graph, scales of the horizontal and vertical axes are not special scales such as logarithms, but typical arithmetic scales.

It could be confirmed from results show in FIG. 5 that the distance L was preferably set to a range within which it satisfies Formula (4) above, and more preferably to a range within which it satisfies Formula (5) above.

Figure 6:
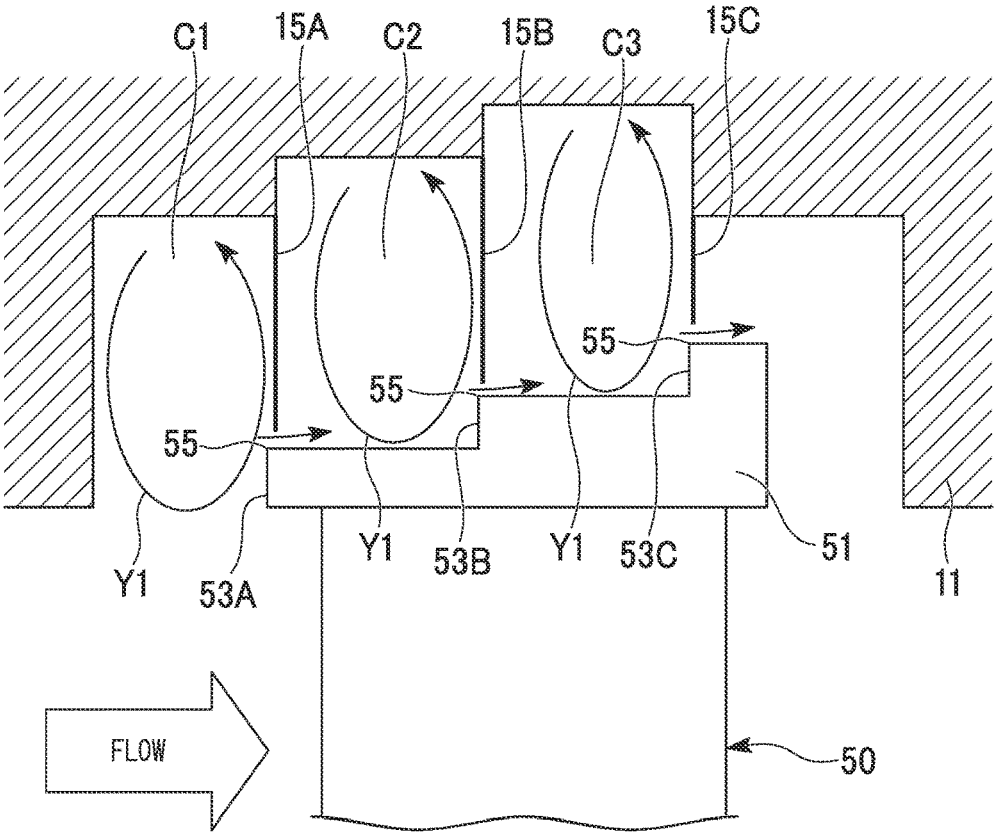
FIG. 6 is a flow pattern explanatory view of a range [1] of FIG. 5.

In the range [1] (L<0.7H) shown in FIG. 5, it could be confirmed that, as shown in FIG. 6, the counter vortex Y2 was not generated by the end edges 55, and for this reason, no downflows were formed on the axial upstream side of the seal fins 15. Accordingly, the flow contracting effect exerted on the leakage flow caused by the downflows was hardly obtained, and as shown in FIG. 5, the leakage amount change rate was high (+ side), i.e. the leakage flow rate was increased. Thus, the turbine efficiency change was low (− side), i.e. the turbine efficiency was reduced.

Figure 7:
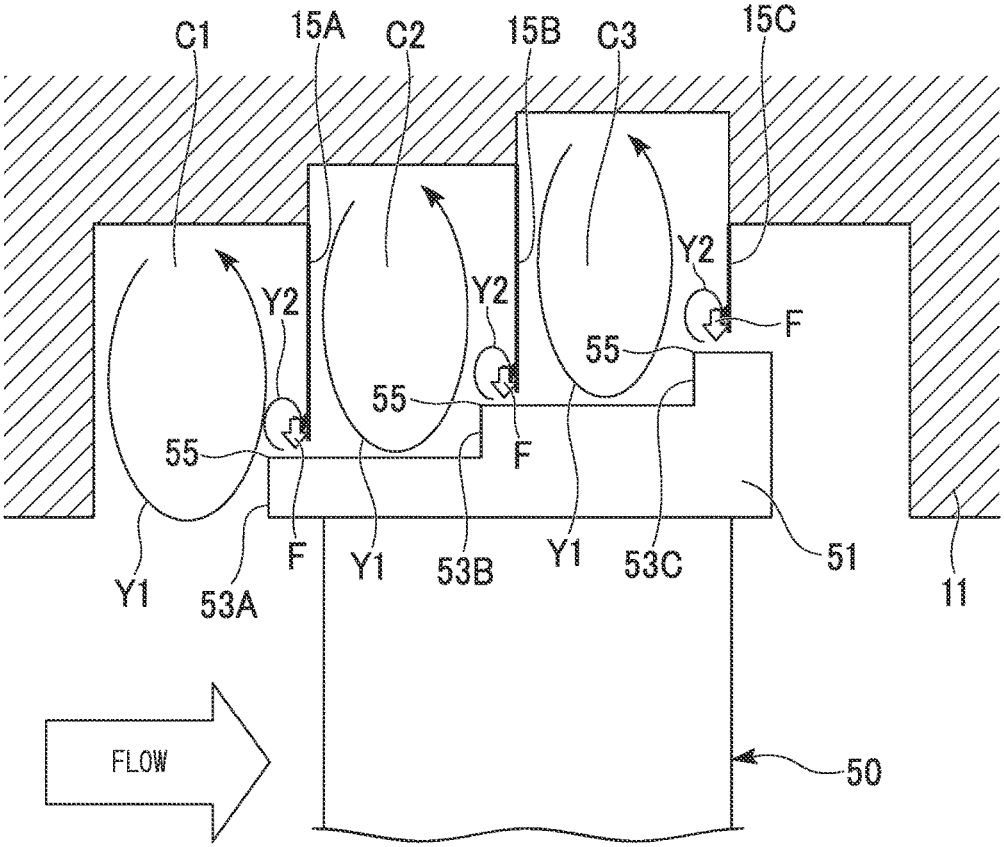
FIG. 7 is a flow pattern explanatory view of a range [2] of FIG. 5.

In the range [2] (0.7H≤L≤0.3W) shown in FIG. 5, i.e. within the range of Formula (4), it could be confirmed that, as shown in FIG. 7, the counter vortexes Y2 were generated by the end edges 55, and for this reason, strong portions (arrow F) of the downflows thereof were adapted to be located adjacent to the tips of the seal fins 15. Accordingly, the flow contracting effect exerted on the leakage flow caused by the downflows was sufficiently obtained, and as shown in FIG. 5, the leakage amount change rate was low (− side), i.e. the leakage flow rate was reduced. Thus, the turbine efficiency change was high (+ side), i.e. the turbine efficiency was improved.

In the range [2a] (0.7H≤L<1.25H) shown in FIG. 5, it could be confirmed that the counter vortexes Y2 were generated by the end edges 55, but were relatively small, and the strongest portions F of the downflows were located at positions corresponding to the interior of the minute clearance H of the radial inner side beyond the tips of the seal fins 15. Accordingly, as shown in FIG. 5, the flow contracting effect exerted on the leakage flow caused by the downflows was sufficiently obtained, but was low compared to the range [2] to be described below.

In the range [2b] (1.25H≤L≤2.75H) shown in FIG. 5, it could be confirmed that the strong counter vortexes Y2 were generated by the end edges 55, and the strongest portions F of the downflows of the counter vortexes Y2 were nearly consistent with the tips of the seal fins 15. Accordingly, as shown in FIG. 5, the flow contracting effect exerted on the leakage flow caused by the downflows became highest.

Especially, as described above, when L was in the vicinity of 2H, the leakage flow rate was minimized, and the turbine efficiency was maximized.

Further, in the range [2c] (2.75H<L≤0.3W) shown in FIG. 5, it could be confirmed that the counter vortexes Y2 generated by the end edges 55 were increased, and the strongest portions F of the downflows began to be separated on the radial outer side beyond the tips of the seal fins 15. Accordingly, as shown in FIG. 5, the flow contracting effect exerted on the leakage flow caused by the downflows was sufficiently obtained, but was low compared to the range [2b].

Figure 8:
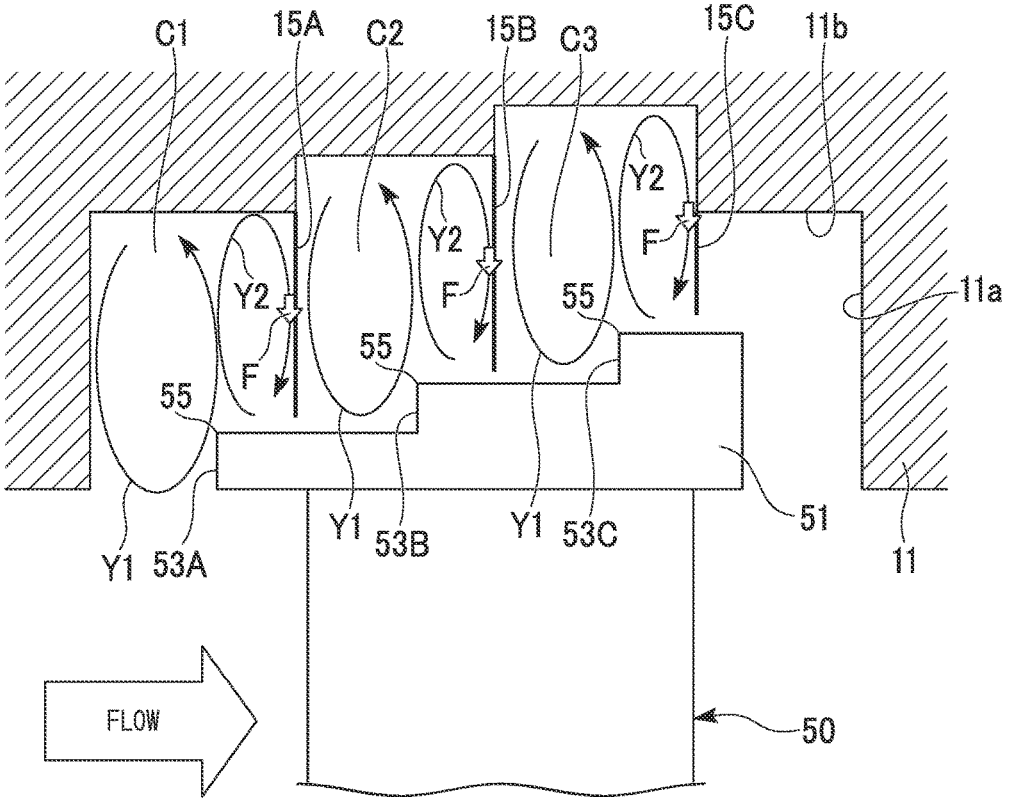
FIG. 8 is a flow pattern explanatory view of a range [3] of FIG. 5.

Further, in the range [3] (0.3W<L) shown in FIG. 5, as shown in FIG. 8, the counter vortexes Y2 generated by the end edges 55 attached to the groove bottoms 11*b* of the annular groove 11*a*, and large vortexes were formed. For this reason, the strongest portions F of the downflows of the counter vortexes Y2 moved to the vicinity of a medium height of the seal fins 15. For this reason, it could be confirmed that the strong downflows were not formed at the tip portions of the seal fins 15. Accordingly, the flow contracting effect exerted on the leakage flow caused by the downflows was hardly obtained, and as shown in FIG. 5, the leakage amount change rate was high (+ side), i.e. the leakage flow rate was increased. Thus, the turbine efficiency change was low (− side), i.e. the turbine efficiency was reduced.

According to the aforementioned simulation results, in the present embodiment, the distance L is set to the range within which it satisfies Formula (4) above.

Thereby, in the respective cavities C1 to C3, mutual position relations between the respective step part 52A to 52C and the seal fins 15A to 15C corresponding to the step parts, as well as between the cavity widths W, satisfy Formula (4) above, i.e., $0.7H \leq L \leq 0.3W$. For this reason, the flow contracting effect caused by the counter vortexes Y2 becomes sufficiently high, and the leakage flow rate is considerably reduced compared to the related art. Accordingly, in the steam turbine 1 having this seal structure, the leakage flow rate can be further reduced, and the high performance thereof can be realized.

Further, when the distance L is set to the range in which it satisfies Formula (5), i.e., $1.25H \leq L \leq 2.75H$, the flow contracting effect caused by the counter vortexes Y2 increases, and the leakage flow rate is further reduced. For this reason, according to the steam turbine 1, the higher performance thereof can be realized.

Further, in the steam turbine 1, the step parts are formed in three stages, and thus the three cavities C are formed. For this reason, in each cavity C, the leakage flow rate caused by the aforementioned flow contracting effect can be reduced, and reduction of the more sufficient leakage flow rate as a whole can be achieved.

INDUSTRIAL APPLICABILITY

According to the turbine, due to the flow contracting effect and the differential pressure reduction caused by the counter vortexes, it is possible to reduce the leakage flow rate of the fluid, and to achieve high performance thereof

REFERENCE SIGNS LIST

1: steam turbine (turbine)
10: casing
11: partition plate outer ring (structure)
11*a*: annular groove
11*b*: groove bottom
15 (15A to 15C): seal fin
30: shaft (structure)
40: turbine vane (blade)
41: hub shroud
50: turbine blade (blade)
51: tip shroud
52 (52A to 52C): step part
53 (53A to 53C): step face
54: inner wall
55: end edge
C (C1 to C3): cavity
H (H1 to H3): minute clearance
W (W1 to W3): cavity width
D (D1 to D3): cavity height
L (L1 to L3): distance
S: steam
Y1: main vortex
Y2: counter vortex

The invention claimed is:

1. A turbine comprising:

a turbine blade which rotates around a shaft axis; and a partition plate outer ring being provided at a tip portion of the turbine blade with a gap between the tip portion of the turbine blade and the partition plate outer ring, an inner surface of the partition plate outer ring being provided with an annular groove, wherein the tip portion of the turbine blade is provided with a step part having a step face that protrudes from the tip portion of the turbine blade toward the partition plate outer ring, the annular groove of the partition plate outer ring is provided with seal fins extending out with respect to the step part and forming clearance (H) between the step part and the seal fins, the step part facing the seal fins is configured to protrude so that a cavity forming a main vortex and counter vortex being formed by the main vortex are formed on an upstream side of the seal fins, and the cavity is formed so that an axial width dimension (W) and a radial height dimension (D) satisfy Formula (1) below $$0.45 \leq D/W \leq 2.67 \quad (1).$$

2. The turbine according to claim 1, wherein the cavity is formed so that the axial width dimension (W) and the radial height dimension (D) satisfy Formula (2) below $$0.56 \leq D/W \leq 1.95 \quad (2).$$

3. The turbine according to claim 2, wherein the clearance (H) and distances (L) between the seal fins and end edges of the step part which are located on the upstream side of the step part are formed to satisfy Formula (4) below with respect to at least one of the distances (L)

$$0.7H \leq L \leq 0.3W \quad (4).$$

4. The turbine according to claim 3, wherein the clearance (H) and the distances (L) between the seal fins and the end edges of the step part which are located on the upstream side of the step part are formed to satisfy Formula (5) below with respect to at least one of the distances (L)

$$1.25H \leq L \leq 2.75H (\text{where } L \leq 0.3W) \quad (5).$$

5. The turbine according to claim 2, wherein the clearance (H) and distances (L) between the seal fins and end edges of the step part which are located on the upstream side of the step part are formed to satisfy Formula (5) below with respect to at least one of the distances (L)

$$1.25H \leq L \leq 2.75H (\text{where } L \leq 0.3W) \quad (5).$$

6. The turbine according to claim 1, wherein the cavity is formed so that the axial width dimension (W) and the radial height dimension (D) satisfy Formula (3) below $$0.69 \leq D/W 1.25 \quad (3).$$

7. The turbine according to claim 6, wherein the clearance (H) and distances (L) between the seal fins and end edges of the step part which are located on the upstream side of the step part are formed to satisfy Formula (4) below with respect to at least one of the distances (L)

$$0.7H \leq L \leq 0.3W \quad (4).$$

8. The turbine according to claim 7, wherein the clearance (H) and the distances (L) between the seal fins and the end edges of the step part which are located on the upstream side of the step part are formed to satisfy Formula (5) below with respect to at least one of the distances (L)

$$1.25H \leq L \leq 2.75H (\text{where } L \leq 0.3W) \quad (5).$$

9. The turbine according to claim 6, wherein the clearance (H) and distances (L) between the seal fins and end edges of the step part which are located on the upstream side of the step part are formed to satisfy Formula (5) below with respect to at least one of the distances (L)

$$1.25H \leq L \leq 2.75H \text{(where } L \leq 0.3W) \quad (5).$$

10. The turbine according to claim 1, wherein the clearance (H) and distances (L) between the seal fins and end edges of the step part which are located on the upstream side of the step part are formed to satisfy Formula (4) below with respect to at least one of the distances (L)

$$0.7H \leq L \leq 0.3W \quad (4).$$

11. The turbine according to claim 10, wherein the clearance (H) and the distances (L) between the seal fins and the end edges of the step part which are located on the upstream side of the step part are formed to satisfy Formula (5) below with respect to at least one of the distances (L)

$$1.25H \leq L \leq 2.75H \text{(where } L \leq 0.3W) \quad (5).$$

12. The turbine according to claim 1, wherein the clearance (H) and distances (L) between the seal fins and end edges of the step part which are located on the upstream side of the step part are formed to satisfy Formula (5) below with respect to at least one of the distances (L)

$$1.25H \leq L \leq 2.75H \text{(where } L \leq 0.3W) \quad (5).$$

13. The turbine according to claim 1, wherein the step part comprises a plurality of step parts which are arranged so that protrusion heights of the step parts from the tip portion of the turbine blade are gradually increased from an axial upstream side to an axial downstream side, and the seal fins are disposed to correspond to the respective step parts.

14. A turbine comprising:

a partition plate outer ring; and a turbine blade being provided inside the partition plate outer ring with a gap between the turbine blade and the partition plate outer ring, the turbine blade rotating around a shaft axis, wherein an inner surface of the partition plate outer ring is provided with an annular groove having a step shape that protrudes from the partition plate outer ring toward the turbine blade, a tip portion of the turbine blade is provided with seal fins extending out with respect to the annular groove of the partition plate outer ring and forming clearance (H) between the groove bottom of the annular groove and the seal fins, the groove bottom of the annular groove facing the seal fins is configured to protrude so that a cavity forming a main vortex and counter vortex being formed by the main vortex are formed on an upstream side of the seal fins, and the cavity is formed so that an axial width dimension (W) and a radial height dimension (D) satisfy Formula (1) below $$0.45 \leq D/W \leq 2.67 \quad (1).$$

15. The turbine according to claim 14, wherein the cavity is formed so that the axial width dimension (W) and the radial height dimension (D) satisfy Formula (2) below $$0.56 \leq D/W \leq 1.95 \quad (2).$$

16. The turbine according to claim 15, wherein the clearance (H) and distances (L) between the seal fins and the groove bottom of the annular groove which are located on the upstream side of the step part are formed to satisfy Formula (4) below with respect to at least one of the distances (L)

$$0.7H \leq L \leq 0.3W \quad (4).$$

17. The turbine according to claim 16, wherein the clearance (H) and the distances (L) between the seal fins and the groove bottom of the annular groove which are located on the upstream side of the step part are formed to satisfy Formula (5) below with respect to at least one of the distances (L)

$$1.25H \leq L \leq 2.75H \text{(where } L \leq 0.3W) \quad (5).$$

18. The turbine according to claim 15, wherein the clearance (H) and distances (L) between the seal fins and the groove bottom of the annular groove which are located on the upstream side of the step part are formed to satisfy Formula (5) below with respect to at least one of the distances (L)

$$1.25H \leq L \leq 2.75H \text{(where } L \leq 0.3W) \quad (5).$$

19. The turbine according to claim 14, wherein the cavity is formed so that the axial width dimension (W) and the radial height dimension (D) satisfy Formula (3) below $$0.69 \leq D/W \leq 1.25 \quad (3).$$

20. The turbine according to claim 19, wherein the clearance (H) and distances (L) between the seal fins and the groove bottom of the annular groove which are located on the upstream side of the step part are formed to satisfy Formula (4) below with respect to at least one of the distances (L)

$$0.7H \leq L \leq 0.3W \quad (4).$$

21. The turbine according to claim 20, wherein the clearance (H) and the distances (L) between the seal fins and the groove bottom of the annular groove which are located on the upstream side of the step part are formed to satisfy Formula (5) below with respect to at least one of the distances (L)

$$1.25H \leq L \leq 2.75H \text{(where } L \leq 0.3W) \quad (5).$$

22. The turbine according to claim 19, wherein the clearance (H) and distances (L) between the seal fins and the groove bottom of the annular groove which are located on the upstream side of the step part are formed to satisfy Formula (5) below with respect to at least one of the distances (L)

$$1.25H \leq L \leq 2.75H \text{(where } L \leq 0.3W) \quad (5).$$

23. The turbine according to claim 14, wherein the clearance (H) and distances (L) between the seal fins and the groove bottom of the annular groove which are located on the upstream side of the step part are formed to satisfy Formula (4) below with respect to at least one of the distances (L)

$$0.7H \leq L \leq 0.3W \quad (4).$$

24. The turbine according to claim 23, wherein the clearance (H) and the distances (L) between the seal fins and the groove bottom of the annular groove which are located on the upstream side of the step part are formed to satisfy Formula (5) below with respect to at least one of the distances (L)

$$1.25H \leq L \leq 2.75H \text{(where } L \leq 0.3W) \quad (5).$$

25. The turbine according to claim 14, wherein the clearance (H) and distances (L) between the seal fins and the groove bottom of the annular groove which are located on the upstream side of the step part are formed to satisfy Formula (5) below with respect to at least one of the distances (L)

$$1.25H \leq L \leq 2.75H \text{(where } L \leq 0.3W\text{)} \quad (5).$$

26. The turbine according to claim 14, wherein the groove bottom comprises a plurality of groove bottoms which are arrange that protrusion heights of the groove bottom from the inner surface of the partition plate outer ring are gradually increased from an axial upstream side to an axial downstream side, and the seal fins are disposed to correspond to the respective the groove bottom of the annular groove.

* * * * *